United States Patent [19]

Führing et al.

[11] 4,045,174

[45] Aug. 30, 1977

[54] METHOD OF CLEANING TEXTILES

[75] Inventors: Heinrich Führing, Augsburg; Johannes Helmut Sieber, Aystetten, both of Germany

[73] Assignee: Böwe, Böhler & Weber KG Maschinenfabrik, Augsburg, Germany

[21] Appl. No.: 539,993

[22] Filed: Jan. 10, 1975

[30] Foreign Application Priority Data

Jan. 11, 1974 Germany ..... 2401296

[51] Int. Cl.[2] ..... D06L 1/00

[52] U.S. Cl. ..... 8/142; 8/137; 134/10; 134/40

[58] Field of Search ..... 8/142, 137; 134/10, 134/40

[56] References Cited

U.S. PATENT DOCUMENTS

| | | | |
|---|---|---|---|
| 1,851,015 | 3/1932 | Olsen | 8/142 |
| 3,404,943 | 10/1968 | Morris | 8/137 |
| 3,493,320 | 2/1970 | Case et al. | 8/142 |

*Primary Examiner*—Joseph L. Schofer
*Assistant Examiner*—W. Schulz
*Attorney, Agent, or Firm*—Karl F. Ross; Herbert Dubno

[57] ABSTRACT

A load of garments or other textile material to be washed is presoaked in organic solvent, e.g. in a rotating drum, and is then immersed within the same vessel in a water bath while still permeated by a substantial quantity of solvent. During this immersion, the vessel is gradually heated to the boiling point of the solvent, or of the azeotropic water/solvent mixture, which is below the boiling point of water so that only a part of the wash liquor is vaporized. The evaporation can be accelerated by placing the vessel under a partial vacuum. The evaporation rate of the solvent is measured and the washing cycle is halted as soon as that rate drops to zero or below a predetermined limit, with subsequent drying of the load by, for example, centrifugation.

5 Claims, 1 Drawing Figure

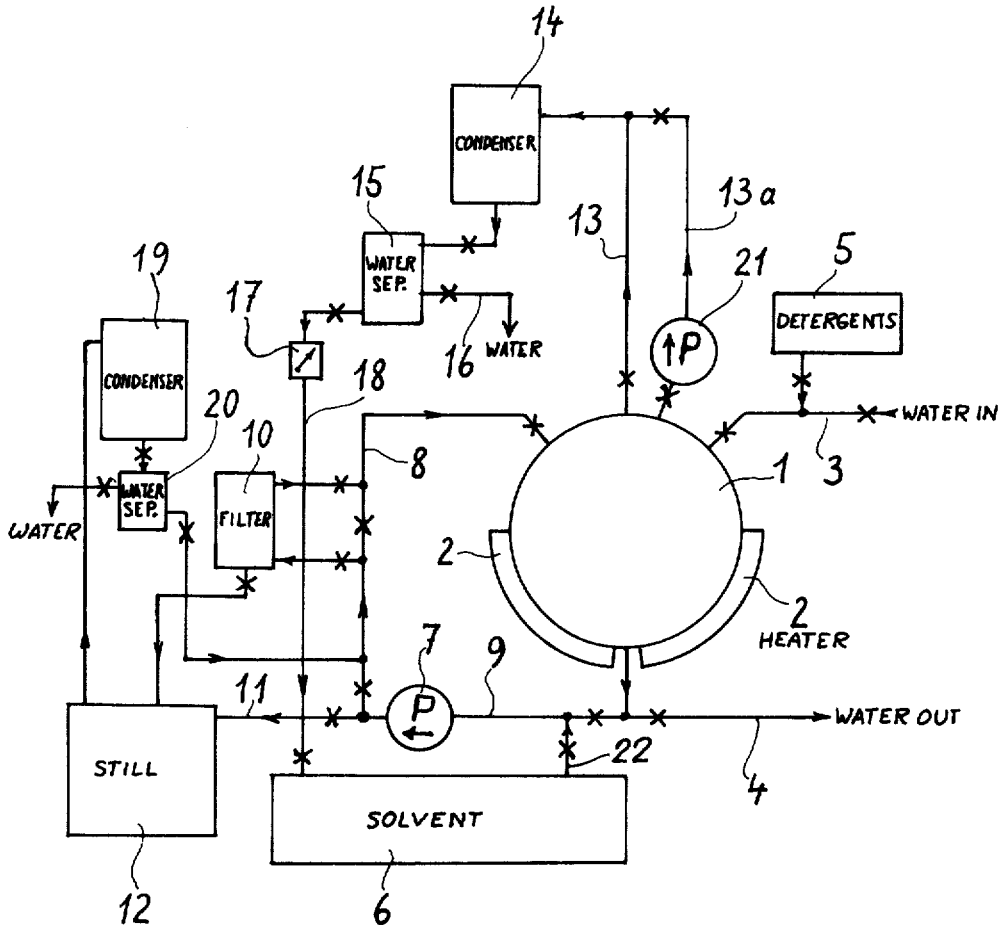
14
CONDENSER
15
WATER SEP.
16
WATER
13
13a
21
P
5
DETERGENTS
WATER IN
3
1
2
2
HEATER
19
CONDENSER
17
18
20
WATER SEP.
WATER
10
FILTER
8
7
P
9
11
WATER OUT
22
4
STILL
12
SOLVENT
6

METHOD OF CLEANING TEXTILES

FIELD OF THE INVENTION

Our present invention relates to a method of cleaning garments and other textiles.

BACKGROUND OF THE INVENTION

Soiled textiles are generally cleaned in one of two ways, i.e. either by washing in water with the aid of suitable adjuvants such as detergents and bleaches or by dry cleaning in an organic solvent such as, for example, perchloroethylene or trichlorotrifluoroethane. The wet washing in an an aqueous medium is normally cheaper but less effective in the presence of oily or fatty stains whose removal requires a high concentration of detergents; the dumping of such a detergent-rich liquor into a sewer contributes greatly to the pollution of the environment. On the other hand, a treatment in an organic solvent requires thorough drying and solvent recovery for economic reasons as well as for environmental considerations.

Certain processes are known in which water and organic solvents are jointly used in the treatment of textiles, e.g. as an emulsion or a micellar solution. The washing of garments or the like in such a medium, however, has not proved very effective inasmuch as graying of white articles cannot be avoided even with prolonged rinsing. Water-soluble soil can be removed only imperfectly with such mixtures.

The use of hot water for the removal of a residue of organic solvent from sheet material subjected to an impregnation process has been suggested in British Pat. No. 812,894. It is also known from U.S. Pat. No. 3,783,560, granted to us jointly with others and partly owned by the assignee of our present application, to dye textiles with the aid of a mixture of organic solvent and water and to rinse the dyed goods in a water bath which is heated to extract the residual solvent by evaporation. No comparable technique, however, has heretofore been applied to the cleaning of textiles as far as we are aware.

OBJECT OF THE INVENTION

The object of our present invention, therefore, is to provide an improved method of cleaning textiles, efficiently and with minimum effect upon the environment, as well as a machine particularly adapted to carry out this method.

SUMMARY OF THE INVENTION

In accordance with the method aspects of our present invention, a load of textiles to be cleaned is immersed in a water bath after presoaking in an organic solvent after removal of excess solvent but without intermediate drying, i.e. with substantially all the immobile solvent still permeating the textile fibers. While the load is being agitated in the bath, the latter is heated to a temperature below the boiling point of water at which the solvent is vaporized, the immersion being terminated as soon as the solvent content of the bath has been reduced substantially to zero or at least below a predetermined threshold.

Dependent on whether or not the solvent forms with the water an azeotropic solution, the solvent residue transferred from the textile fibers by the water vaporizes either with or without an accompanying proportional amount of water. If a vapor mixture results, we prefer to condense same and to isolate the solvent in a water separator; by measuring the rate of solvent outflow from the water separator, or from the condenser directly if no significant amounts of water are evaporated, we can determine the instant when the solvent content of the bath drops below the established limit. The evolution of solvent vapor from the bath can be assisted by the creation of a partial vacuum with the aid of a suction pump.

As the temperature of the bath is raised to the boiling level of the solvent, or of its azeotropic mixture with water, its cleansing effect is considerably enhanced. The soil removed from the load by both constituents of the mixture remains in the hot bath which is gradually depleted of its solvent content and which may be continuously circulated through the treatment vessel, preferably a rotating drum, during this final washing phase. After the solvent has evaporated and the remaining water has been drained from the vessel, the load may be partly dried by centrifugation before being extracted.

An apparatus for carrying out this method in accordance with our invention, resembling in many respects a conventional washing machine, comprises a treatment vessel provided with the usual agitating means, e.g. a motor-driven drum rotatable about a horizontal or vertical axis, a supply of washing water and a source of lower-boiling organic solvent connectable with that vessel via suitable inlet means. This arrangement makes it possible to presoak the load in substantially pure solvent before letting in the water along with whatever detergents or other adjuvants are to be added to the bath. The vessel is further provided with heating means for vaporizing the solvent, as described above, and with outlet means for removing the vaporized solvent from the vessel. The rate of solvent recovery is determined by measuring means of the type already discussed.

BRIEF DESCRIPTION OF THE DRAWING

The above and other features of our invention will now be described in detail with reference to the accompanying drawing the sole FIGURE of which diagramatically represents a washing machine adapted to carry out our improved textile-cleaning method.

SPECIFIC DESCRIPTION

The machine shown in the drawing includes a conduit system with numerous valves (X), not individually identified, which can be operated by a conventional programmer as will be readily apparent to persons skilled in the art. The treatment vessel 1 in the form of a rotary drum, here centered on a horizontal axis, is provided along its underside with heating elements 2 such as steam pipes. An inlet 3, adapted to communicate with a detergent receptacle 5, leads into the drum 1 which is provided with an outlet 4 and with conduits 8, 9 for the recirculation of its contents with the aid of a pump 7. A solvent reservoir 6 has an exit port 22 which can be connected with conduit 9 upstream of pump 7 for the introduction of solvent into the drum at the beginning of a washing cycle. A filter 10 can be inserted into the closed circuit 7 – 9 for the removal of insoluble solids.

Spent solvent can be withdrawn through a line 11 from the circuit and delivered to a still 12 from which solvent vapors are fed to a condenser 19, a recirculated solvent being returned from that condenser via a water separator 20 to the circuit 7 – 9. Still 12 may also receive a liquid collected in filter 10.

A conduit 13 leads evolving vapors from drum 1 to another condenser 14 discharging its contents into a water separator 15. The solvents recovered in that water separator pass through a flow meter 17 into the tank 6. A line 13*a* in parallel with conduit 13 contains a suction pipe 21 for the generation of a partial vacuum in drum 1 to promote the vaporization of the solvent contained in the treatment bath. Flow meter 17 is inserted in a line 18.

In operation, solvent such as perchloroethylene from tank 6 is admitted into the loaded drum 1 and is recirculated by pump 7 for the removal of organically soluble soil and loosely adhering solids. Thereafter, excess solvent is extracted by pump 7 and delivered to still 12, preferably with continuing rotation of drum 1, the extraction of the solvent being terminated while a substantial amount thereof is still retained in the fibers of the load. Next, the solvent-permeated load is immersed in water admitted by way of inlet 3, with addition of a desired quantity of detergents from receptacle 5. The bath temperature in drum 1 is now raised by means of heaters 2 while the water inlet 3 and the solvent inlet 22 are cut off; pump 7 may continue to operate at this stage to recirculate the bath liquor through conduits 8 and 9, thereby flushing all solvent remnants from these conduits to the drum for evaporation. The evolving vapors, passing through line 13 or 13*a* to condenser 14, are reliquefied and separated at unit 15 into their aqueous and organic constituents, the latter flowing at a progressively decreasing rate through meter 17. As soon as that rate falls below a predetermined limit, heating is stopped, the drum is drained via outlet 4 and the load is centrifugated in the rotating drum until it is dry enough to be removed from the vessel.

It will thus be seen that existing washing machines can be readily modified for the practice of our invention.

We claim:

1. A method of cleaning textiles, comprising the steps of:

presoaking a load of textiles to be cleaned within a vessel in an organic dry cleaning solvent vaporizable, at least when in an aqueous azeotropic mixture, at a boiling point lower than that of water;

removing excess solvent from the presoaked textiles while leaving some wetted with residual solvent;

immersing the solvent-wetted textiles within said vessel in a detergent-enriched water bath with resulting transfer of residual solvent from said textiles to the bath;

washing said textiles by agitation in said bath while increasing the bath temperature to a level below the boiling point of water but high enough to vaporize said solvent, thereby progressively depleting said bath of solvent;

measuring the rate of vaporization of said solvent; and terminating the immersion upon a dropping of said rate to substantially zero.

2. A method as defined in claim 1 wherein said bath is placed under a partial vacuum during vaporization of said solvent.

3. A method as defined in claim 1 wherein the step of agitating said textiles includes a continuous circulation of the bath liquor through said vessel.

4. A method as defined in claim 1, comprising the further step of centrifuging said textiles in said vessel upon termination of the immersion by draining the bath liquor from said vessel.

5. A method as defined in claim 1 wherein said solvent is perchloroethylene.

* * * * *